US008100257B1

(12) United States Patent
Zimmer

(10) Patent No.: US 8,100,257 B1
(45) Date of Patent: Jan. 24, 2012

(54) SUB BASKET

(76) Inventor: John C. Zimmer, New Iberia, LA (US)

( * ) Notice: Subject to any disclaimer, the term of this patent is extended or adjusted under 35 U.S.C. 154(b) by 604 days.

(21) Appl. No.: 11/739,506

(22) Filed: Apr. 24, 2007

Related U.S. Application Data

(63) Continuation-in-part of application No. 11/682,719, filed on Mar. 6, 2007.

(60) Provisional application No. 60/780,629, filed on Mar. 9, 2006.

(51) Int. Cl.
*E21B 19/14* (2006.01)

(52) U.S. Cl. ..... 206/303; 206/443; 211/70.4

(58) Field of Classification Search ..... 206/443, 206/303, 379, 391, 493, 446, 445, 321; 211/60.1, 211/69, 70.4; 248/511, 512, 519, 539
See application file for complete search history.

(56) References Cited

U.S. PATENT DOCUMENTS

| | | | | | |
|---|---|---|---|---|---|
| D152,655 | S | * | 2/1949 | Rossell | D11/147 |
| 3,602,368 | A | * | 8/1971 | Gould | 206/598 |
| 4,033,455 | A | * | 7/1977 | Robison | 206/391 |
| 4,291,803 | A | * | 9/1981 | Perales | 206/443 |
| 4,397,395 | A | * | 8/1983 | McKelvey | 211/69 |
| 4,858,302 | A | * | 8/1989 | Stribiak | 483/3 |
| 4,946,036 | A | * | 8/1990 | Kupersmit | 206/386 |
| 5,040,708 | A | * | 8/1991 | Blair et al. | 223/106 |
| 5,078,415 | A | * | 1/1992 | Goral | 280/79.2 |
| 5,628,400 | A | * | 5/1997 | Feder | 206/379 |
| 5,878,882 | A | * | 3/1999 | Kohagura | 206/379 |
| 5,971,345 | A | * | 10/1999 | Khalaf | 248/512 |
| 6,092,342 | A | * | 7/2000 | Sharapata | 52/298 |
| 6,145,682 | A | * | 11/2000 | Speck et al. | 220/1.5 |
| D453,884 | S | * | 2/2002 | Wang | D6/469 |
| 6,450,330 | B1 | | 9/2002 | Cannata | |
| 6,880,709 | B2 | * | 4/2005 | Chen | 211/70.6 |
| 6,883,268 | B2 | * | 4/2005 | Fraser | 43/54.1 |
| 6,883,666 | B1 | * | 4/2005 | Wang | 206/600 |
| 7,066,329 | B2 | * | 6/2006 | Riley | 206/443 |
| 2001/0040111 | A1 | * | 11/2001 | Spradlin et al. | 206/391 |
| 2002/0074300 | A1 | * | 6/2002 | Sanders | 211/70.6 |
| 2006/0169617 | A1 | * | 8/2006 | Knight et al. | 206/443 |

* cited by examiner

*Primary Examiner* — J. Gregory Pickett
*Assistant Examiner* — Robert Poon
(74) *Attorney, Agent, or Firm* — Jones Walker

(57) ABSTRACT

A sub basket having a bottom portion and four sides defining an interior, and an open top section, and a series of pins positioned on the floor portion of the sub basket and extending into the interior of the sub basket where the pins are sized to allow a sub to slide over the pins.

11 Claims, 13 Drawing Sheets

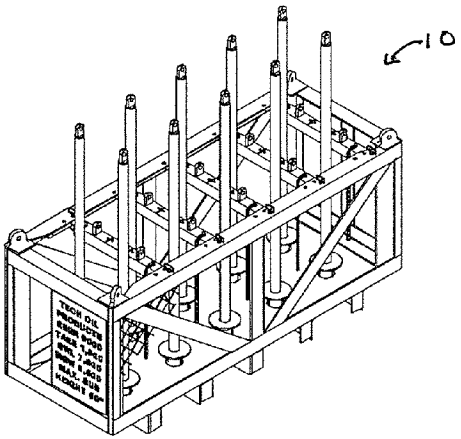
FIG 12
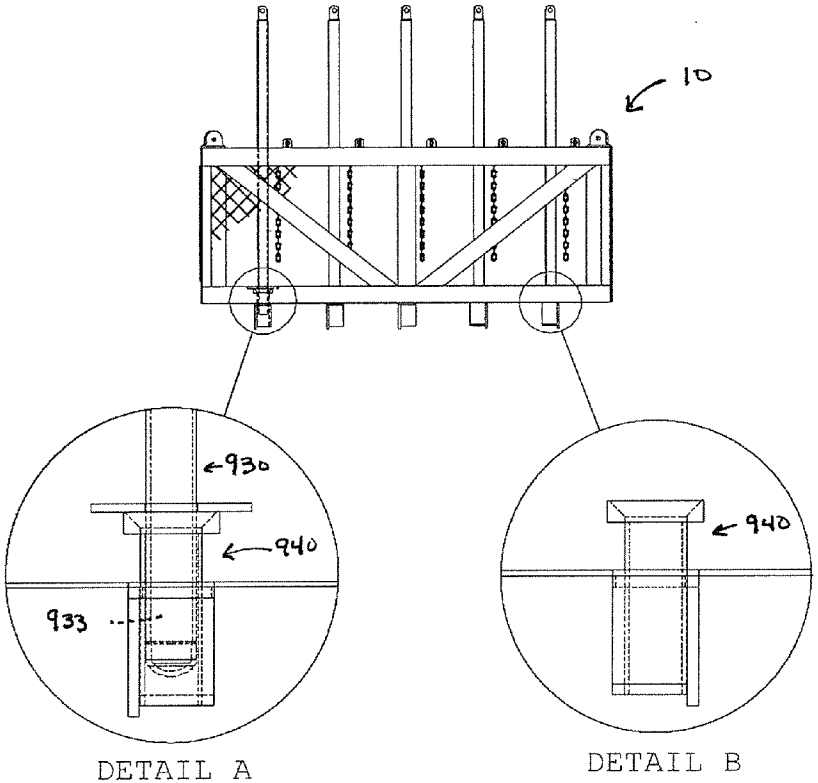

SUB BASKET

PRIORITY CLAIM

This application is a continuation in part of U.S. application Ser. No. 11/682,719 filed on Mar. 6, 2007, which application claimed priority to U.S. Provisional application 60/780,629 filed on Mar. 9, 2006. Applicant claims the priority benefit of both applications.

BACKGROUND

An oilfield sub (or "sub") is a short joint of pipe (1'-10') used to lengthen a pipe string, change from one size of pipe to another, reduce the ID of the pipe, or add a tool to the string. The terminal ends of each sub will have internal or external threads to allow for attaching the sub. Lifting a sub has previously been done by either wrapping a sling around the sub to lift it or by threading an eyelet plug or collar to one of the threaded ends of the sub and lifting the sub from the attached eyelet plug or collar. However, the threading on subs varies, and it can be difficult to identify a suitable lifting plug or collar for a particular sub. Consequently, an improper sized plug or collar could be used, creating the possibility of a sub slipping off the lifting plug or collar when lifted. Because the subs are heavy and awkward to move, both lifting methods present safety hazards.

Subs are usually placed in an "offshore basket" or junk basket for storage and shipping. The subs are stacked sidewise one on top of another. Removing subs from such a basket can result in injury due to the effort needed to retrieve a stored dub. One sub or many being may be placed on top of the needed sub, resulting in stored subs being rolled, picked up, or removed from the basket in order to get the desired sub. Hands and fingers can be injured in this process, and the sub's threading can be damaged by this type of handling.

SUMMARY OF THE INVENTION

This invention stacks subs upright into an open toped basket which allows subs to be handled in a timely and safe manner. The invention includes a series of pins positioned in the interior of the basket, each pin accommodating a sub. The pins may be fixed to the basket, or removable. A moveable safety brace can be positioned across the top of the sub basket to which an installed sub can be lashed or latched to secure the sub in place. The brace may be moved out of the way when the sub is to be lifted from the basket. The invention is designed so that the subs do not come in contact with each other, the threads are protected, and safety is accomplished by stopping the need to roll one sub off of another or pull subs from under one another. Loading and unloading can be done by sling or plug, safely and efficiently

BRIEF DESCRIPTION OF THE DRAWINGS

FIG. 12 shows the completed sub basket using the cup of FIG. 10 and pin of FIG. 11 mated in detail A.

DETAILED DESCRIPTION OF THE PREFERRED EMBODIMENT OF THE INVENTION

Figure 1:
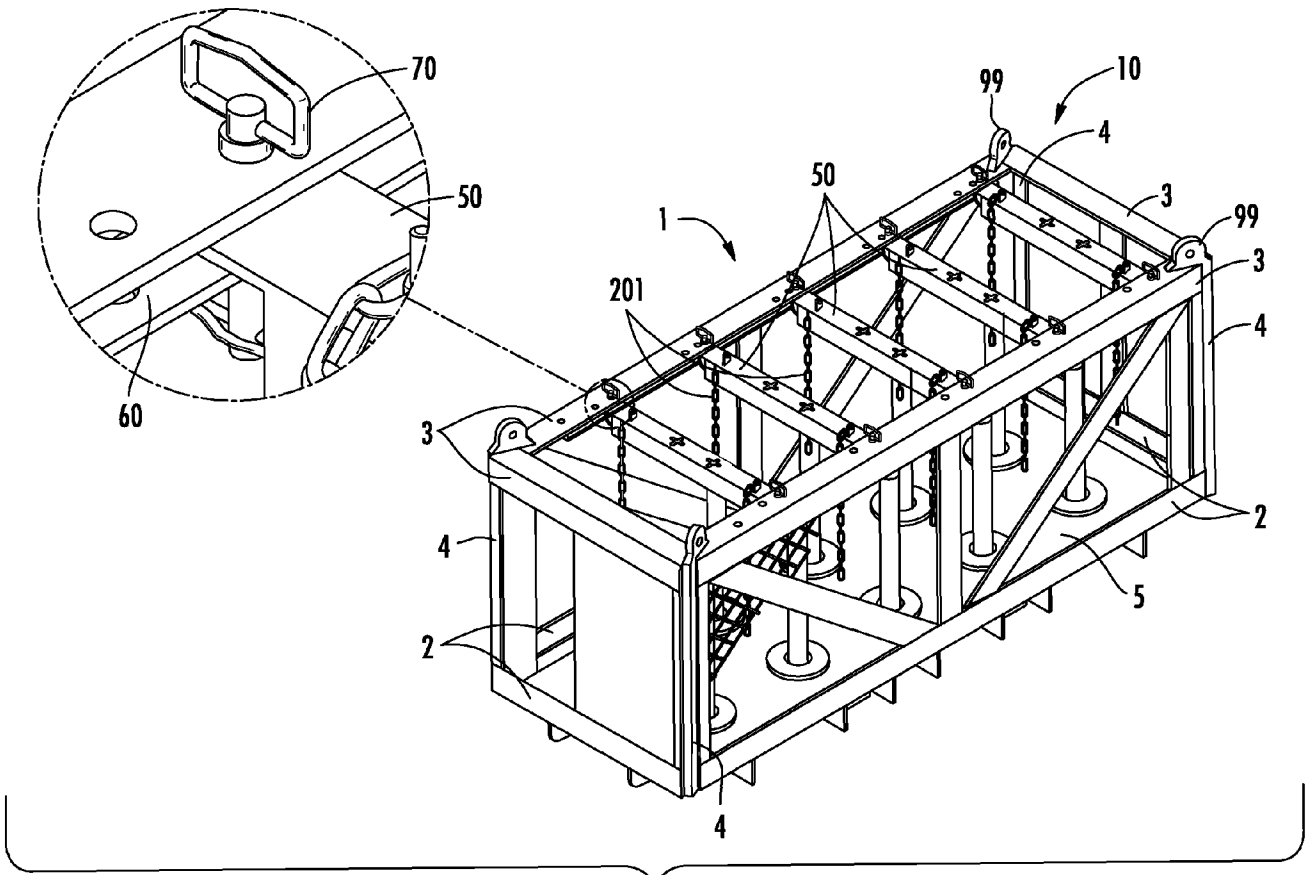
FIG. 1 is a prospective view of the sub basket
Figure 2:
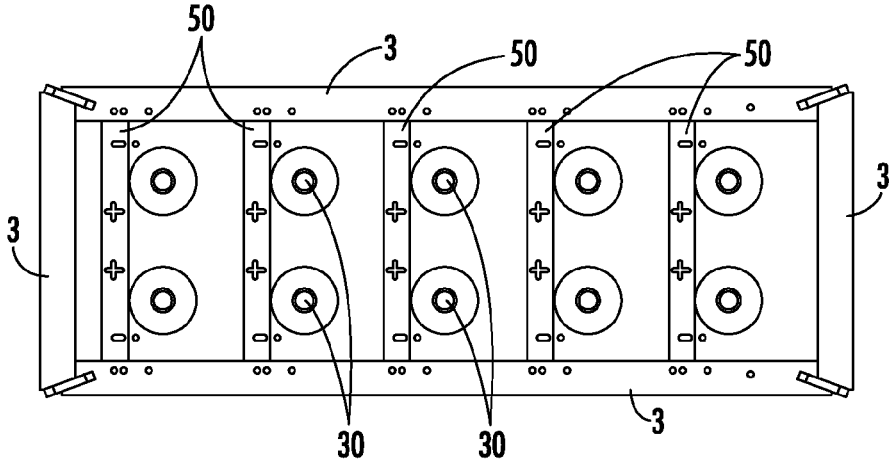
FIG. 2 is a top view of the sub basket

Shown in FIG. 1 is one embodiment of the sub basket 10. The basket 10 is a storage case for subs. The basket 10 has a frame or skeleton structure 1 including four floor frame members 2 (creating a floor rectangle); four top frame members 3 (creating a top rectangle), and at least four side frame members 4 connecting the top frame and frame bottom members. As shown, the frame members are "L" shaped plate steel. Additional frame members may be needed for strength, for instance, additional side diagonal bracing frame members are shown in FIG. 1.

The frame 1 creates an open rectangular box like structure. The basket 10 has an interior floor portion 5, which can be a solid panel floor or a series of generally parallel bars or slats extending from opposing sides of the bottom frame members. As shown in FIG. 1, the floor 5 is an insert of sheet steel that attaches to the floor frame members 2. The frame also includes a plurality of floor joists 6A and legs 6 that support the basket and raise the floor 5 above ground level. The frame also includes fork lift channels 7 positioned on the underside of the floor portion to provide a means to lift the frame with a fork lift (see FIG. 3). The floor and four sides of the basket can be "closed" with metal mesh, plate metal of metal bars or plates.

As shown in FIG. 1, the four side frame members 4 terminate at the top of the basket in latch points 99. The latch points 99 allow the entire basket 10 to be lifted and moved as a unit. As shown, each latch point 99 is an eyelet angled to face the center of the basket to ensure proper distribution of loads during a lifting operation.

Figure 3:
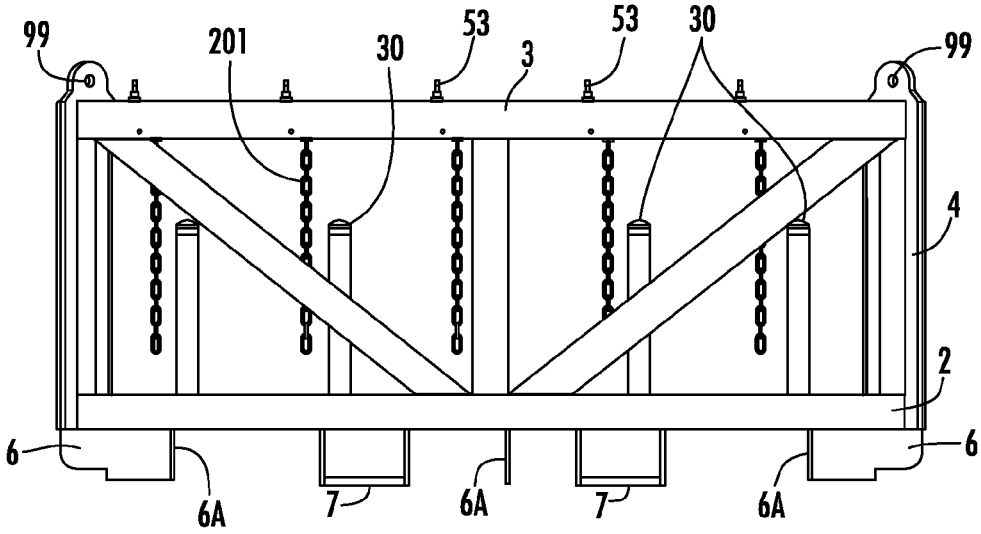
FIG. 3 is a side view of the sub basket

Positioned on the floor portion 5 of the basket 10 are a number of upstanding pins 30 (see FIG. 3). A pin 30 can be from several inches to several feet in length, depending on the application. The pins 30 extend from the floor portion of the basket into the interior of the basket. Pins 30 can be constructed from pipe, bar, rod or other linear shaped material (round, square, etc). The sub basket of FIG. 1 contains ten pins positioned in five columns, each column containing two pins 30.

Figure 9:
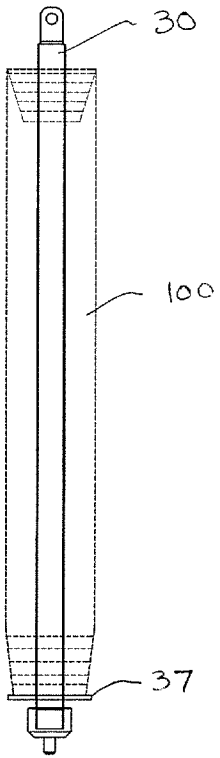
FIG. 9 shows a sub positioned on a removable pin.

In use, subs are stored in the basket 10 by placing or sliding a sub onto a pin 30 for upright storage in the interior of the basket 10. FIG. 9 shows a sub 100 mounted onto a particular pin 30. The outer diameter of the pin 30 should be less than the inner diameter of most subs to allow the sub to slide over the pin 30, and a diameter of 2⅜ inches (schedule 80 pipe heavy walled pipe) has been found adequate for most subs. Additionally, the exterior of the pin 30 can be lined with Teflon or UHMW to prevent damage to the threads of a stored sub. The basket shown in FIG. 1 is sized to accommodate ten subs (basket size about 8'×3'), but the dimensions of the basket can vary based upon the desired sub storage capacity.

Fixed Pins

Pins 30 can be fixed to the floor, such as by welding, or the pins can be removable from the basket. In a fixed pin configuration, the pins 30 should be securely attached to the basket frame, such as by welding the pin to the frame floor joists 6A. To store a sub onto a fixed pin, the sub is overhead lifted (such as by using an eyelet plug and lifting with a crane), positioning the raised sub over a pin 30 in vertical alignment, and then lowering the sub over the pin, that is, the sub slides onto the pin for storage. In a fixed pin embodiment, it is preferred that the pin length be less than the sub length so that the pin does not protrude through the top of the sub and interfere with placement of the sub onto the pin 30. With a fixed pin embodiment, lifting a sub still entails the risk of mismatched threads on a sub and lifting eyelet. To reduce this risk, a removable pin may be used.

Removable Pins

Figure 4:
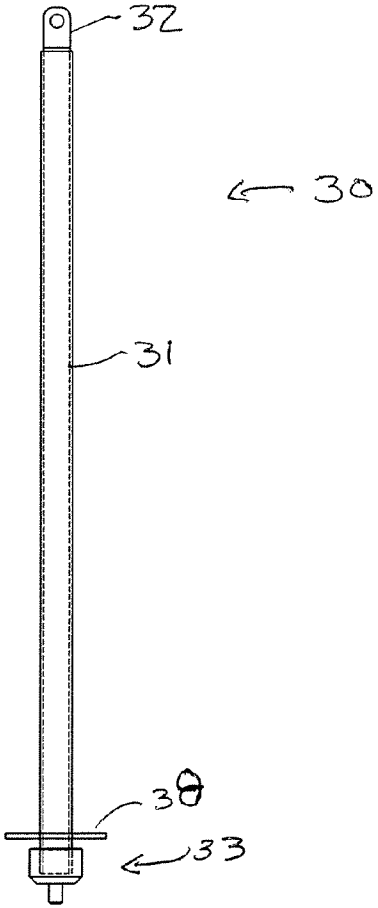
FIG. 4 is a side view of one embodiment of a removable pin.
Figure 5:
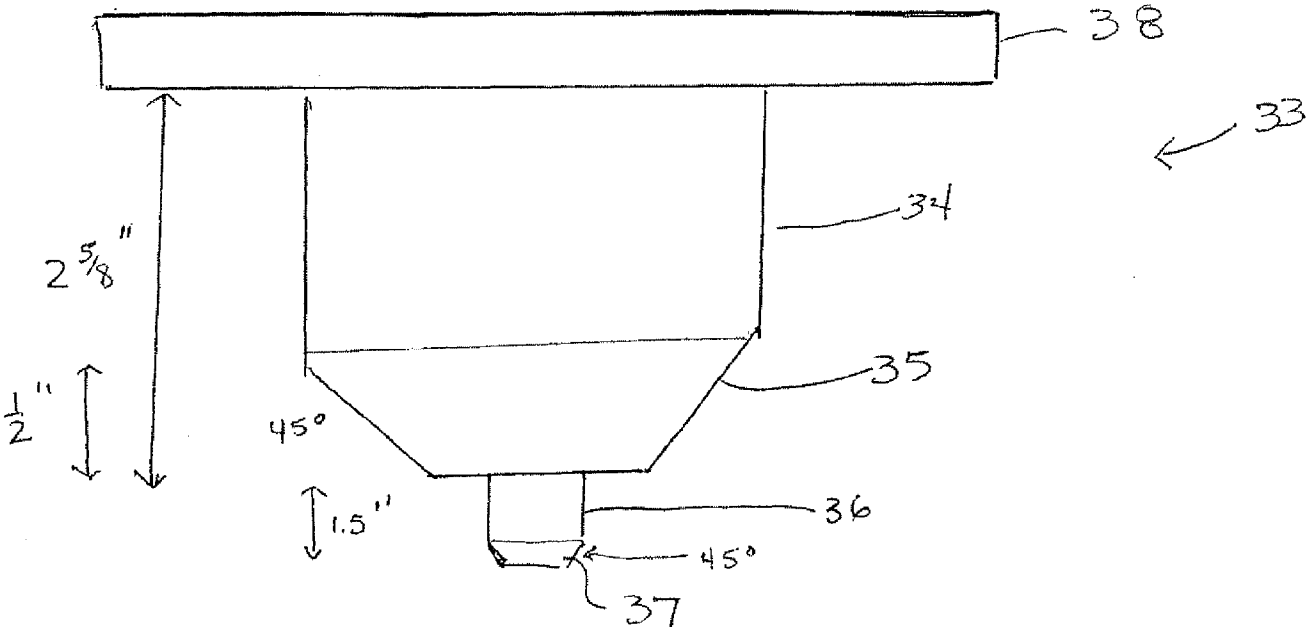
FIG. 5 is a side view of the pin base section

With a removable pin 30 embodiment, an installed pin 30 must be adapted to be joined with a fixture located on the floor 5 to allow the pin to remain in a substantially stable, upright configuration. One such arrangement is detailed in FIGS. 4, 5 and 6. Shown in FIG. 4 is a removable pin 30, having a pin body 31, top lifting eyelet 32, terminal base section 33 and surrounding flange 38. The base section 33 of the pin 30 is configured to join (such as by "keying" or inter mating) with a fixture positioned on the floor portion 5 of the basket 10. One embodiment of a base section 33 has a first downwardly protruding cylinder 34 having a tapered or beveled bottom edge, 35 and a second downwardly protruding cylinder 36 or rod centered on the first protruding cylinder 34. The second protruding cylinder 36 also has a tapered bottom edge 37. The second protruding cylinder 36 on the pin base 30, while not required, is a desired safety feature as it prevents a pin from being stood upright when decoupled from a fixture.

Figure 6A:
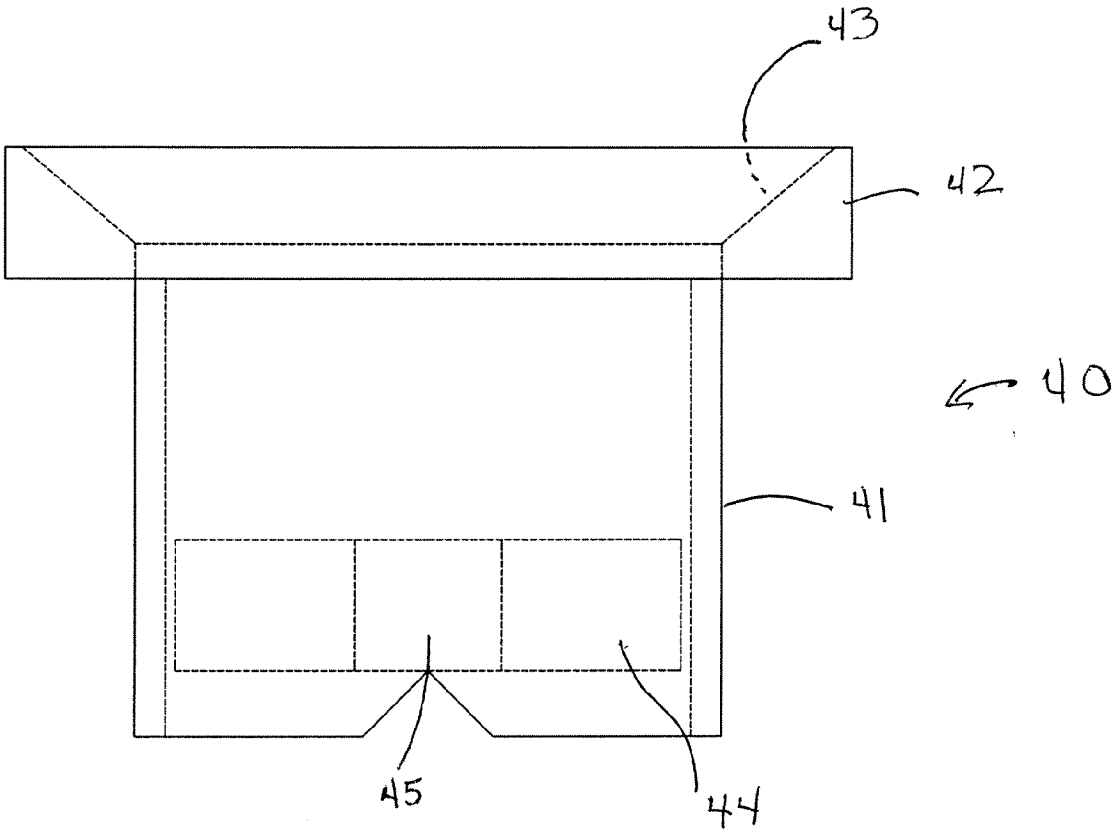
FIG. 6A is a side view of the one embodiment of a cup
Figure 6B:
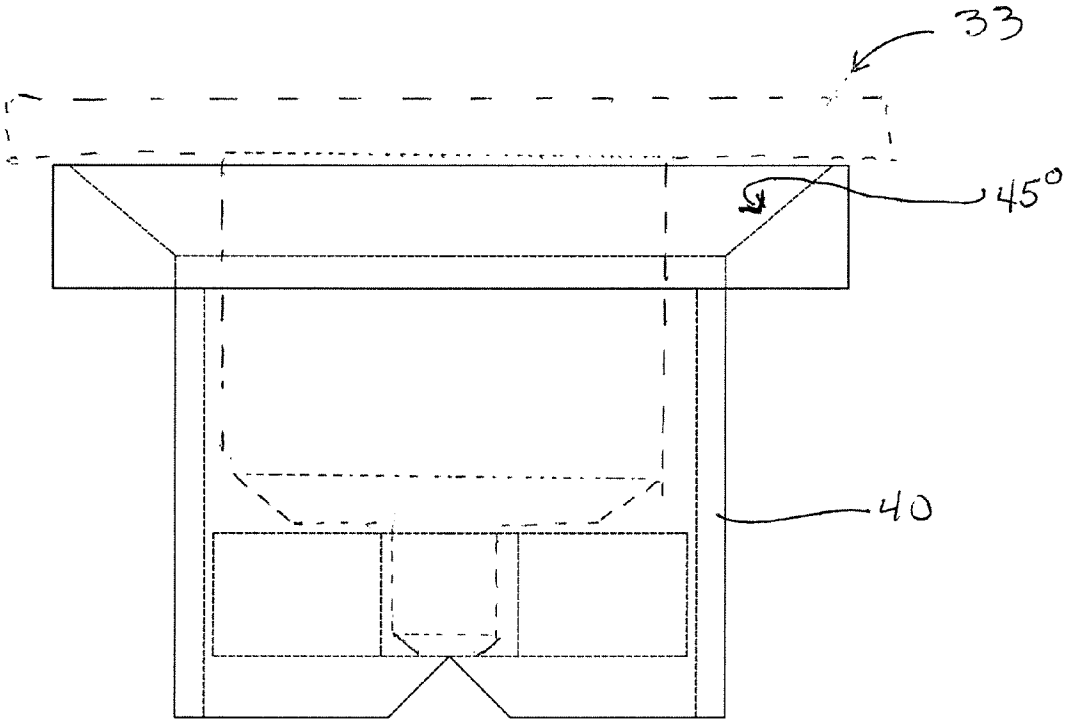
FIG. 6B shows the relationship between the cup of FIG. 6A and the base section of FIG. 5.

This base section joins with a floor fixture, shown as a cup 40 in FIG. 6A. The cup 40 is welded to the frame joints or joists 6A, and has an upstanding cylindrical wall 41 with an open flanged top 42. The flanged top 42 is beveled on the top facing interior edge 43. The interior of the cup is sized to accommodate the protruding cylinders 34 and 36 of the pin base 33. The cup 40 has a floor section 44 with a center opening 45 sized to accommodate the second protruding cylinder 36 of the pin base 33. Once joined, the pin base section 33 is keyed into the cup's 40 interior, thus maintaining the installed pin 30 in an upright position. A pin base 33 is shown installed in a cup 40 in FIG. 6B.

The tapered edges 35 and 37 of the protruding cylinders are designed allow these edges to slide across the beveled interior edge 43 of the cup's flange 42, thereby assisting the pin base 33 to "self center" into the cup 40 when the pin is lowered into the cup. This arrangement will guide the lowering pin 30 into the proper alignment with respect to the cup 40 so that the pin base 33 will fully drop into and engage with the cup 40. In this fashion, workers will only have to minimally assist in guiding a removable pin 30 into position over a cup, thereby reducing the risk of worker injury.

Other geometries between the pin base 30 and the floor fixtures could be utilized to accomplish the needed ability to rest the pin 30 upright in a stable fashion on the floor 5 of the basket 10. For instance, the pin could be a hollow pin body, open on the bottom, and having a bottom flange. The floor fixture could be an upstanding pipe or rod fixed to the floor and sized to be inserted into the hollow interior pin. Here, the pin would be lowered over the rod or pin, in a nested relationship, much like the sub sliding over a pin. This "pin over rod" arrangement is not as stable as the above described pin base/cup combination and is not preferred, but is used to demonstrate the flexibility in designing a pin and floor fixture combination.

Figure 10:
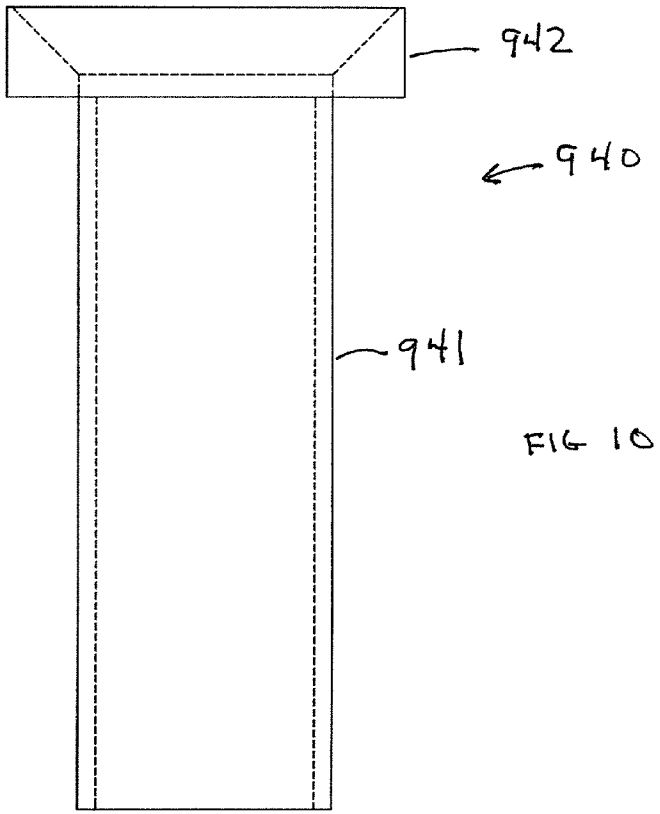
FIG. 10 shows another embodiment of a cup.
Figure 11:
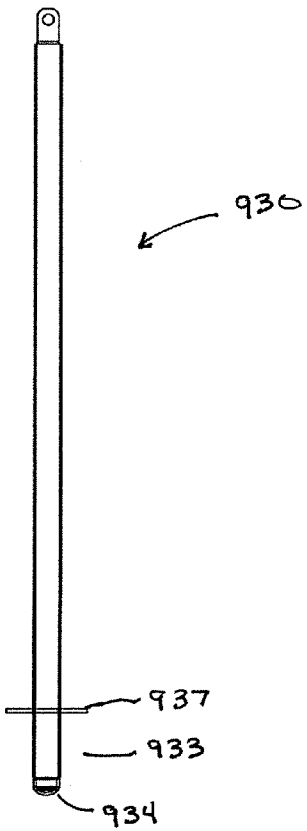
FIG. 11 shows an embodiment of a removable pin that inserts into the cup shown in FIG. 10

A second embodiment of removable pin/floor fixture is detailed in FIGS. 10, 11 and 12. Shown in FIG. 10 is a floor fixture or cup 940. Floor fixture 940 is a hollow upstanding cylinder 941 capped or terminating with an open flanged top 942, much like the open flange top 42 on the cup shown in FIG. 6A. The flange 942 is elevated about three inches off the sub basket floor by the upstanding cylinder 941, and the upstanding cylinder extends about 5 inches below the floor to allow the cylinder to be secured to the baskets frame and floor joists.

The removable pin 30 that is inserted into this floor fixture 940 is shown in FIG. 11 as reference 930. This pin 930 corresponds to the removable pin of FIG. 4 except the base section 933 has a rounded end section 934, generally welded onto the base section. The base section begins with outwardly extending flange 937. The length of the base section is about 7.5 inches, and consequently, the pin base will extend into the cup about 7.5 inches. FIG. 12 shows a complete sub basket using cups 940 and pins 930. Detail A in FIG. 12 shows the removable pin 930 inserted into the floor fixture 940.

With a removable pin 30, workers can mount a pin 30 onto a sub with the pin removed from the basket 10. For instance, workers can slide a removable pin 30 through a sub that is positioned horizontally on the ground or the drill floor. It is preferred that the pin be long enough to extend through the entire sub body, and for many subs, a pin length of about five feet is sufficient. A lifting line is then attached to the pin eyelet 32 (now protruding though the top of the sub) and the combined pin/sub would be raised. In transit or lifting, the sub is supported by the pin base flange 37. The ability to lift and move a sub/pin combination by using the eyelet on the pin body prevents the problems associated with mismatched threads between the sub and lifting plug or collar.

Once a sub is stored on the pin 30 (either removable of fixed) the sub still has some freedom to move (it may slightly wobble about the vertical). Further, if the basket 10 is tilted during transport, stored subs could slide off the pins 30. Both types of movement are dangerous to workers. A means to stabilize the subs to the basket is desired. To accomplish this, one embodiment uses a restraining brace 50 positioned across the top edge of the basket, to which a stored sub will be lashed. One such restraining brace is shown in FIG. 8.

Figure 7:
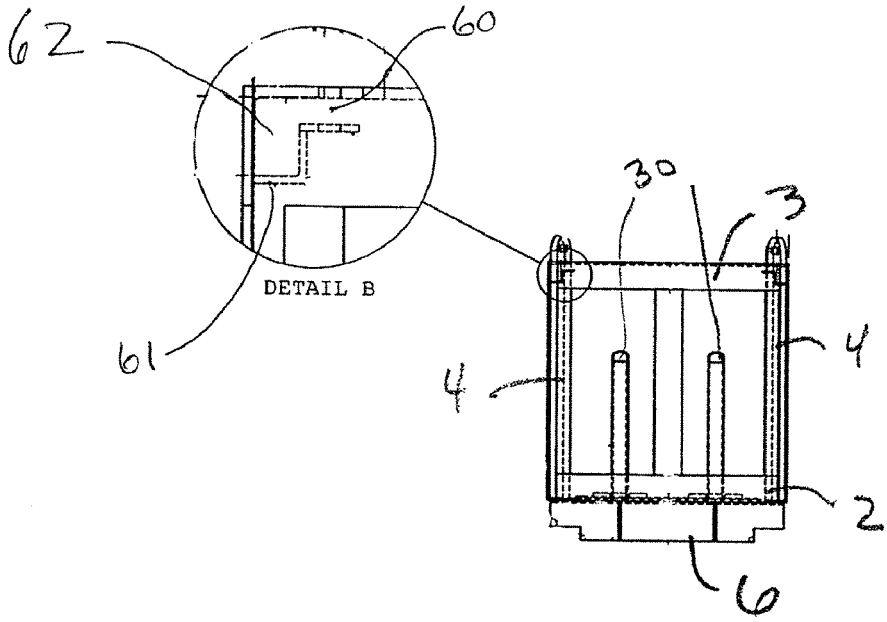
FIG. 7 is an end view of the sub basket.

As shown, the brace 50 is an L shaped member. The brace may simply be removably mounted on the top of the basket frame, such as with a pin or bolt, but this arrangement is not preferred as the braces can become readily separated from the basket, and lost. An arrangement to retain the brace to the frame is shown in FIG. 1. Here the brace 50 slides in a groove 60 located on the top edges of the basket (see Detail A of FIG. 1). The groove 60 is created a "z" shaped bar 61 mounted on two opposing sides of the basket top edges. To prevent the brace 50 from sliding out of the groove, the brace 50 has terminal downwardly extending tabs or rollers 51 that slide in a second groove 62 created by the "z" bar 61, shown in Detail B of FIG. 7. In another embodiment, the braces 50 could have a groove positioned on the terminal ends of each brace, with the top frame members slidable in this groove.

A brace 50 can be slid in the grooves until it butts up against a sub 100 stored in the basket. The brace 50 is then set in position with respect to the basket frame 1, such as by pinning the brace 50 to the basket with a bolt or pin 70 positioned through an opening in the brace end that aligns with openings in the top frame members 5. (See FIG. 1). The installed sub 100 is then secured to the brace 50, for instance by lashing the sub 100 to the brace 50. To lash the subs 100 to the restraining brace 50, each brace 50 has two straps, wires or chains 201 attached to the brace 50 (one per sub). A strap or chain 201 is wound around a stored sub 100 (possibly several times), and the free end of the strap or chain 201 coupled to the restraining brace 50 or the top frame members 5 to tie down the sub 100. As shown, the restraining brace 50 has a "cross" shaped opening 203 into which the free end of a chain 201 can be inserted, thereby locking the chain 201 in place. By securely lashing the subs 100 to the frame 1, the dangers of transport of a loaded basket 10 are minimized. Even if the lifting sling fails and a lifted basket 10 tilts, the lashed subs 100 should remain stored in the basket 10.

Figure 8:
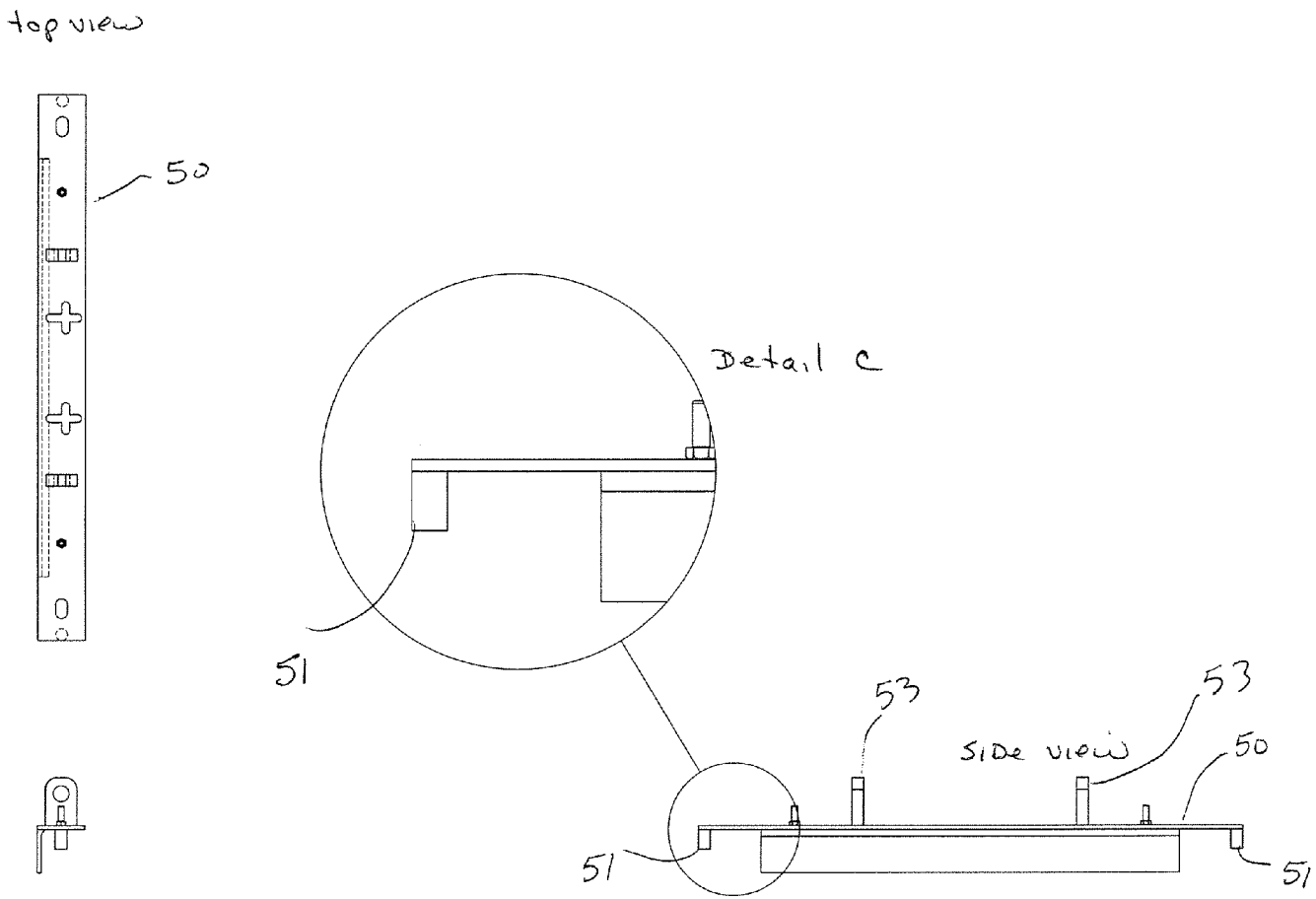
FIG. 8 is a view of a top brace
Figure 13:
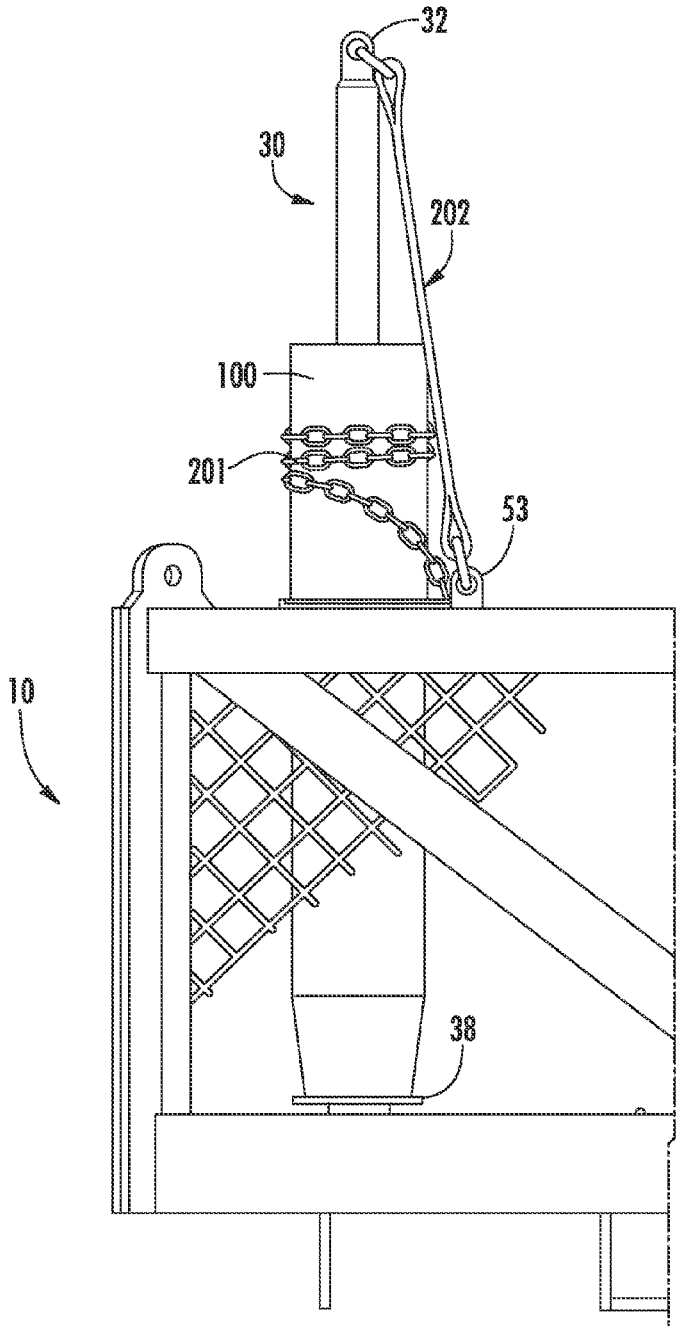
FIG. 13 shows a partial side view of a sub basket with a pin/sub combination contained therein and lashed to the restraining brace by two restraining means.

The sub/pin combination may also be lashed to the frame 1 by attaching a strap, rope, wire or chain 202 to the eyelet 32 of a removable pin 30 and attaching the other end of the strap or chain 202 to the top frame members 5 or braces 50, such as to the eyelets 53 positioned on the brace 50 (see FIG. 8 and FIG. 13). Other means to restrain the subs 100 to the frame 1 can be utilized.

In use, loading, unloading and storage of subs can be safely and more readily accomplished using the sub basket. Loading and unloading can be done by sling or plug, moving the sub directly, or by moving the sub/pin combination if a removable pin is used. Additionally, the frame itself can be picked up by sling or harness using attachment points located on the basket frame. Hence the entire basket and loaded subs can be moved as needed.

The construction of this device takes the need for time, safety, and damage into consideration. A stored sub is easily accessible, and when loaded, is stable within the basket

I claim:

1. A sub basket assembly, comprising:

a frame including a bottom portion, four interconnected sides affixed to the bottom portion, a floor portion affixed to the bottom portion, an interior portion formed by the bottom portion and the interconnected sides, and an open top section permitting access to the interior of the frame;

a plurality of pin-retaining fixtures positioned on the floor portion of the frame within the interior portion thereof;

a plurality of elongated pins each having a top end and a bottom end, the bottom end of each elongated pin including a flange and being detachably affixed to one of the pin-retaining fixtures, the top end of each elongated pin containing a lifting eyelet;

a plurality of subs, each sub including a bottom end, a top end, and a central bore extending from the bottom end to the top end, each sub being slidably positioned on one of the elongated pins, the elongated pin extending through the central bore of the sub with the bottom end of the sub supported by the flange of the bottom end of the elongated pin, the top end of the elongated pin extending external to the top end of the sub, the elongated pin retaining the sub in a substantially upright position;

a plurality of restraining braces, each restraining brace adjustably positioned across the open top section of the frame between opposing sides thereof and in selective cooperation with one or more of the subs positioned on the elongated pins, each said restraining brace detachably affixed to said opposing sides of said open top section of the frame;

a plurality of first lashing means, each first lashing means detachably securing one of the subs to the restraining brace that is in selective cooperation with the sub to prevent lateral movement of the sub while the sub basket is being transported.

2. The sub basket assembly according to claim 1, further comprising a plurality of second lashing means, each second lashing means detachably securing one of the elongated pins, via the lifting eyelet of the elongated pin, to the restraining brace that is in selective cooperation with the sub positioned on the elongated pin to prevent the elongated pin from dislodging from the retaining fixture to which the elongated pin is detachably affixed or to prevent the sub positioned on the elongated pin from dislodging therefrom.

3. The sub basket assembly according to claim 1, wherein each first lashing means is a strap, wire, or chain.

4. The sub basket assembly according to claim 2, wherein each second lashing means is a strap, wire, or chain.

5. The sub basket assembly according to claim 4, wherein each restraining brace has opposing ends and wherein each opposing side of the open top section of the frame includes a channel groove, the channel groove slidably receiving one of the opposing ends of the restraining brace.

6. The sub basket assembly according to claim 5, wherein the opposing ends of each restraining brace includes a downwardly extending retaining member and wherein each opposing side of the open top section of the frame includes a U-shaped groove, the U-shaped groove slidably receiving one of the retaining members of the L-shaped restraining brace.

7. The sub basket assembly according to claim 6, wherein each retaining member is a tab or roller.

8. The sub basket according to claim 5, further comprising a plurality of retaining pins and wherein each opposing side of the open top section of the frame includes a plurality of holes adapted to receive one of the retaining pins and wherein each opposing end of the restraining braces includes a hole adapted to receive one of the retaining pins, each retaining pin extending through one of the holes in the opposing sides of the open top section of the frame and through one of the holes in the opposing ends of the restraining braces to detachably affix the restraining braces to the open top section of the frame.

9. The sub basket according to claim 8, wherein the plurality of holes in each opposing side of the open top section of the frame are arranged in series, each series including two or more spaced-apart holes to provide multiple positions for detachably affixing one of the restraining braces to the open top section of the frame.

10. The sub basket according to claim 2, wherein each restraining brace includes an opening for receiving the first lashing means or the second lashing means.

11. The sub basket according to claim 10, wherein the first or second lashing means is a chain and wherein the opening in each restraining brace is cross-shaped.

* * * * *